US007197986B1

(12) United States Patent
Calkins

(10) Patent No.: US 7,197,986 B1
(45) Date of Patent: Apr. 3, 2007

(54) COMPOSITE STEEL AND CERAMIC GUN BARRELS

(76) Inventor: Noel C. Calkins, P.O. Box 3123, Los Lunas, NM (US) 87031

( * ) Notice: Subject to any disclaimer, the term of this patent is extended or adjusted under 35 U.S.C. 154(b) by 344 days.

(21) Appl. No.: 10/429,644

(22) Filed: May 5, 2003

Related U.S. Application Data

(60) Provisional application No. 60/380,560, filed on May 13, 2002.

(51) Int. Cl.
*F42B 8/00* (2006.01)

(52) U.S. Cl. ..... 102/529; 102/511; 102/435; 42/76.02; 89/14.7

(58) Field of Classification Search ..... 102/511, 102/529, 435; 42/76.02; 89/14.7
See application file for complete search history.

(56) References Cited

U.S. PATENT DOCUMENTS

| | | | | |
|---|---|---|---|---|
| 4,196,670 | A * | 4/1980 | Vatsvog | 102/511 |
| 4,715,284 | A * | 12/1987 | Hendry et al. | 102/434 |
| 5,275,108 | A * | 1/1994 | Chernicky et al. | 102/439 |
| 5,378,499 | A * | 1/1995 | Martin et al. | 427/242 |
| 6,090,756 | A * | 7/2000 | Brown | 508/118 |
| 6,576,598 | B2 * | 6/2003 | Brown | 508/118 |

* cited by examiner

*Primary Examiner*—M. R. Clement
(74) *Attorney, Agent, or Firm*—Rodey Law Firm; DeWitt M. Morgan

(57) ABSTRACT

A method for lubricating gun barrel bores comprises burnishing dry lubricating ceramic particulate into the metal surface of the bore such that the particles of particulate substantially fill grain boundaries in the metal. The burnishing of the particulate may be done manually or mechanically. Mechanically burnishing the particulate includes firing particulate-coated ammunition projectiles or other ammunition-firing pieces coated with particulate.

7 Claims, 8 Drawing Sheets

COMPOSITE STEEL AND CERAMIC GUN BARRELS

This application claims priority based on U.S. Provisional Patent Application Ser. No. 60/380,560, entitled "Composite Steel and Ceramic Gun Barrels," and filed May 13, 2002.

BACKGROUND AND SUMMARY OF THE INVENTION

This invention is in answer to the steady increase of the use of hotter burning gun powder for performance and the full automatic utilization for more rounds per minute. Both characteristics have continued to push the gun barrel life to the limit with regard to hot strength and barrel erosion. Until now, many attempts have been made to improve barrel performance with insufficient success. It is safe to say that gun barrel performance has been one of the primary limits to the increase of gun firepower.

A new method for increasing gun barrel performance is disclosed herein and is more than simply a gun barrel coating or lubricant. The present invention is a simple but effective method for enhancing the performance of the gun barrel itself and introduces additional benefits noted herein.

One object of the present invention is to provide a simple but meaningful method of combining the metal of the gun barrel with a fine particulate ceramic, and combining the advantages of both in a synergistic combination.

Another object of the present invention is to allow a bullet to be primarily guided down a gun barrel by embedded ceramic particulate in the surface of the gun barrel resulting in a reduction in friction and heat compared to a typical gun barrel.

Another object of the present invention is to reduce gun barrel wear by the use of renewable ceramic surfaces.

Another object of the present invention is to reduce or eliminate barrel cleaning. This is especially noteworthy in full automatic firing and black powder applications.

Another object of the present invention is to improve accuracy due to the higher velocity provided by reduced friction and improved bullet to barrel sealing.

Another object of the present invention is to prevent rust corrosion in the barrel bore without the necessity of oiling or other treatment. Another object of the present invention including all of the above is the application of the invention to black powder guns and shotgun wadding or packing.

There are several advantages to the present invention. One result is prolonged gun barrel life allowing for hotter powder loads and higher rates of fire. This is achieved by an original surface interface between bullet and gun barrel being filled by a ceramic dry lubricant which remains in place or is periodically replaced. Another advantage is reduced or eliminated gun barrel cleaning. This results due to excess ceramic particulate being discharged through a barrel muzzle, leaving behind a clean barrel. Another advantage is increased muzzle velocity. This is achieved by the ceramic dry lubricant providing reduced friction and improved bullet seal, reducing vibration or "chatter" of a bullet traveling down the gun barrel. Another advantage is the elimination of gun barrel corrosion. Corrosion or rust can only begin in metal grain boundaries, which, according to the present invention, are filled with the sub-micron sized particles of the ceramic dry lubricant. Another advantage is increased accuracy. This results because the bullet time-to-target is reduced as a result of increased muzzle velocity. Accuracy is increased also due to the reduced stress caused by reduction of friction and heat. Accuracy is also increased as a result of a more consistent bullet seal achieved by the present invention. A final advantage is the inexpensive nature of the present invention, which can be practiced in the field on existing gun barrels.

The present invention uses the materials described herein in the manner in which they are best utilized. The metal surface of the internal bore of a gun barrel is used as a shape and form matrix, and the dry ceramic is used as a lubricant and wear surface. The typical steel barrel has become a standard due to its high heat and strength, its ability to air cool and be mass produced, and its ductility.

The original conception behind the present invention was to provide a practical way to maintain the integrity of a gun barrel in order to maintain accuracy and reduce the maintenance without a great increase in cost. Dry ceramic lubricant, such as boron nitride powder having sub micron-sized particulate applied in a dispersion mode, prevents burning the metal surface of a gun barrel. This offers the best available method of protecting metal surfaces from oxidation works as may be normally anticipated.

The dry ceramic such as boron nitride powder, in submicron size, can be manually rolled or burnished into the grain boundaries of a steel barrel or it can burnished by coating a bullet or other ammunition equipment prior to firing the gun, allowing the bullet to do the burnishing when it is fired. This simplistic method of bullet burnishing was selected because it does not require any special tooling and can allow for field processing. Firing boron nitride powder coated bullets utilizes the velocity, heat, and pressure resulting from the firing to do the work of lodging the ceramic particles into the grain boundaries of the composite steel.

In order to take advantage of the benefits of the present invention by coating bullets with boron nitride powder to fire through the barrel and coat the internal bore, the gun barrel must first be very clean so that the ceramic particulate can be driven into the grain boundaries of the steel composite. This also requires that no lubricant or rust preventative be present. The ceramic also fills unused voids in a gun barrel, such as scratches or wear, thereby affecting an improved seal. Unused particulate passes out of the gun barrel upon firing. Minor excess of boron nitride powder assures that the barrel is clean and ready for the next round. Because the interior surface is then basically the ceramic powder, there is no detriment noted in this process.

The dry ceramic lubricant selectively used in the process comprises boron nitride powder (HBN) having a hexagonal (laminar) microstructure. Such boron nitride powder is considered a dry lubricant because it develops an internal sheer plane in its body, which reduces friction. There are other boron nitride powder types which are relatively hard (e.g. CBN, PBN) which are inappropriate for use in the disclosed method and apparatus herein.

The present invention generally comprises a dry lubricant ceramic that separates the ammunition projectile from the internal bore of a metal gun barrel. This provides a dynamic friction reduction, a dynamic pressure seal, a replaceable wear surface, and a very effective gun bore cleaning action. The present invention has been tested with extremely positive results on shotgun wads (modern plastic material) and black powder muzzle loaders, using boron nitride powder coated patches and sabots.

Secondary Ion Mass Spectrometry (SIMS) testing performed on the surfaces of the internal bore of gun barrels shows that the boron nitride powder used in accordance with the present invention results in the ceramic powder particulates being clearly embedded within the grain boundaries of the metal gun barrel. These test results show that burnishing sub-micron particulate ceramic is effective, and that continued firing of uncoated bullets will continue to experience the advantages of the present invention for an extended period of time. Such testing also shows that excessively coating boron nitride powder onto bullets provides erratic results and sometimes no velocity improvement. Thinner coating on the bullets provides more consistent velocity improvement.

Most of the prior art in this area does not indicate a complete understanding of the application of ceramics in the present invention. Although ceramics, as metal oxides, have many advantages, they also have many disadvantages such as poor tensile strength, poor thermal shock resistance, and difficult and expensive processing. Boron nitride powder in accordance with the present invention, however, provides many distinct advantages while avoiding several of these disadvantages and maintaining basic simplicity and relatively minor cost.

The use of boron nitride powder coatings in black powder guns is also significantly advantageous. Black powder gun shooting generally provides difficult clean up after only a few rounds are fired. Such clean up is nasty and time consuming. Preliminary testing of black powder guns using boron nitride powder coated patches and sabots shows positive results. Results in black powder guns include greater accuracy as well as avoiding the need to clean the bores.

The hexagonal (laminar) structure of boron nitride powder allows it to sheer apart in laminations or layers in the direction of the least friction, similar to what happens using molybdenum disulfide (MO), a well-known dry lubricant. Nevertheless, boron nitride powder has better self-sustaining qualities than MO, which is a refractory metal oxide.

Because of very close grain boundaries in stainless steel gun barrels, the present invention is not as effective as in composite steel gun barrels. Chemical etching or mechanical resurfacing may be required. Furthermore, commercial chrome plating in gun barrels will not permit grain boundary use in accordance with the present invention. As a result, the present invention provides a good replacement for the far more costly chrome plating process and is effective when the heat generated from use of a gun barrel has stripped off the chrome plating in the barrel due to the heat, which inevitably occurs anyway.

DETAILED DESCRIPTION OF EMBODIMENTS OF THE INVENTION

Figure 1:
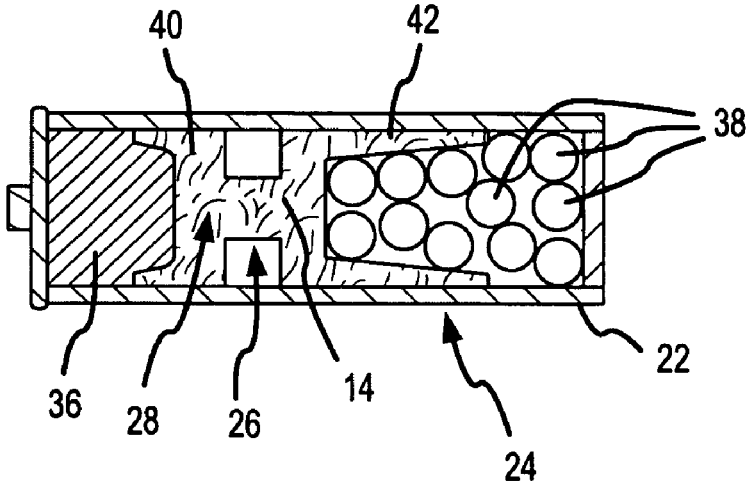
FIG. 1 is a cross-sectional side view of a shotgun shell with a boron nitride powder coated wad.

Various embodiments of a method and of an apparatus are disclosed herein for lubricating composite steel gun barrels 10. As shown in the several drawings, non-exclusive examples of gun barrels for which the present invention is useful include the internal bores 12 of barrels 10 in firearms, such as rifles, shotguns and handguns, and in artillery launchers (not shown), such as are found on military tanks, cannons (e.g. howitzers, bazookas, grenade launchers, and mortar shell launchers), and naval war ships.

In one embodiment, a method for lubricating a gun barrel 10 comprises introducing a suitable dry lubricating ceramic particulate 14 to the internal surface of the barrel 10, i.e. the internal bore 12, and burnishing the particulate into the radially inwardly facing surface 16 of the bore. In other embodiments, burnishing the particulate 14 into the bore 12 causes the particulate particles 18 to substantially fill grain boundaries 20 in the composite steel of the barrel 10.

Stainless steel and chrome-plated steel comprise few, small, or no grain boundaries. In order to prevent corrosion in the internal bore 12, the particulate 14 must fill grain boundaries 20 where corrosion occurs. Thus, in one embodiment, the method further comprises the step of ensuring the surface 16 of internal bore 12 comprises grain boundaries 20 sufficient for receiving the particulate 14. In other embodiments, the method further comprises the step of resurfacing the internal bore 12, such as by mechanical or chemical etching on the surface 16 prior to introducing the particulate 14. In yet other embodiments, the method further comprises the step of removing any corrosion-resistant coating (not shown) from the internal bore 12, such as chrome plating.

In order to substantially fill grain boundaries 20 of the steel with the particulate 14, the particulate particles 18 must be very small, generally sub-micron in cross measurement. In one embodiment, the particulate particles 18 each measure no more than about 2 microns across. In other embodiments, the particles 18 measure less than about 1 micron across.

In addition to selecting particulate 14 having very small particulate particles 18, particulate is selected having anti-corrosion as well as lubricating characteristics, as desired. In one embodiment, the particulate 14 comprises a metal oxide powder. In other embodiments, the particulate 14 comprises boron nitride powder. In yet other embodiments, boron nitride powder comprises a hexagonal (or laminar) crystal structure. In yet other embodiments, the crystal structure of the hexagonal boron nitride power comprises platelet formations. Boron nitride powder having hexagonal crystal structure was found to have favorable performance characteristics in each of the examples disclosed below. Boron nitride powder used in accordance with this disclosure provides the suitable anti-corrosive and lubricity properties required for the present invention.

Burnishing boron nitride powder 14 into the gun barrel bore 12 may be done manually or mechanically. In one embodiment, the boron nitride powder 14 is coated onto the surface 16 manually. This may be done by sprinkling the boron nitride powder 14 onto the internal bore 12, or by dispersing the boron nitride powder 14 in water-based or solvent-based systems (not shown) for spraying or painting the particulate onto the internal bore 12. Once boron nitride powder 14 is introduced onto the internal bore 12, it is burnished such as by rubbing it into the internal bore surface 16 sufficiently to substantially fill grain boundaries 20 in the composite steel of the bore with the boron nitride powder particles 18. In one embodiment, rubbing the boron nitride powder 14 into the steel surface 16 comprises pressure polishing the particulate-coated surface 16 of the steel to ensure proper grain boundary filling.

Introducing and burnishing boron nitride powder 14 onto the bore surface 16 may be done mechanically. In one embodiment, boron nitride powder 14 is rolled into the bore 12 during the shaping and/or formation of the gun barrel 10 during its manufacture. In other embodiments, boron nitride powder 14 is introduced and burnished as a result of normal use of the gun, according to its design and configuration, with corresponding bullets or other shells or munitions, i.e. ammunition projectiles 22. In order to introduce and burnish boron nitride powder 14, in one embodiment, firing an ammunition projectile 22 coated with the boron nitride powder 14 has a sufficient velocity as well as sufficient pressure and temperature conditions such that the boron nitride powder is substantially transferred into the grain boundaries 20 of the steel bore surface 16.

Figure 4:
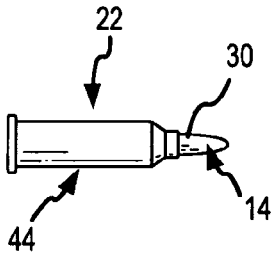
FIG. 4 is a rifle bullet coated with boron nitride powder.
Figure 5:
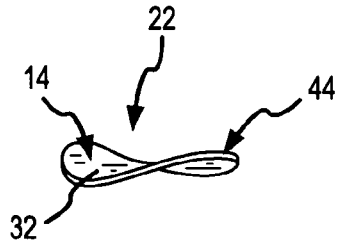
FIG. 5 is a black powder patch coated with boron nitride powder.
Figure 6:
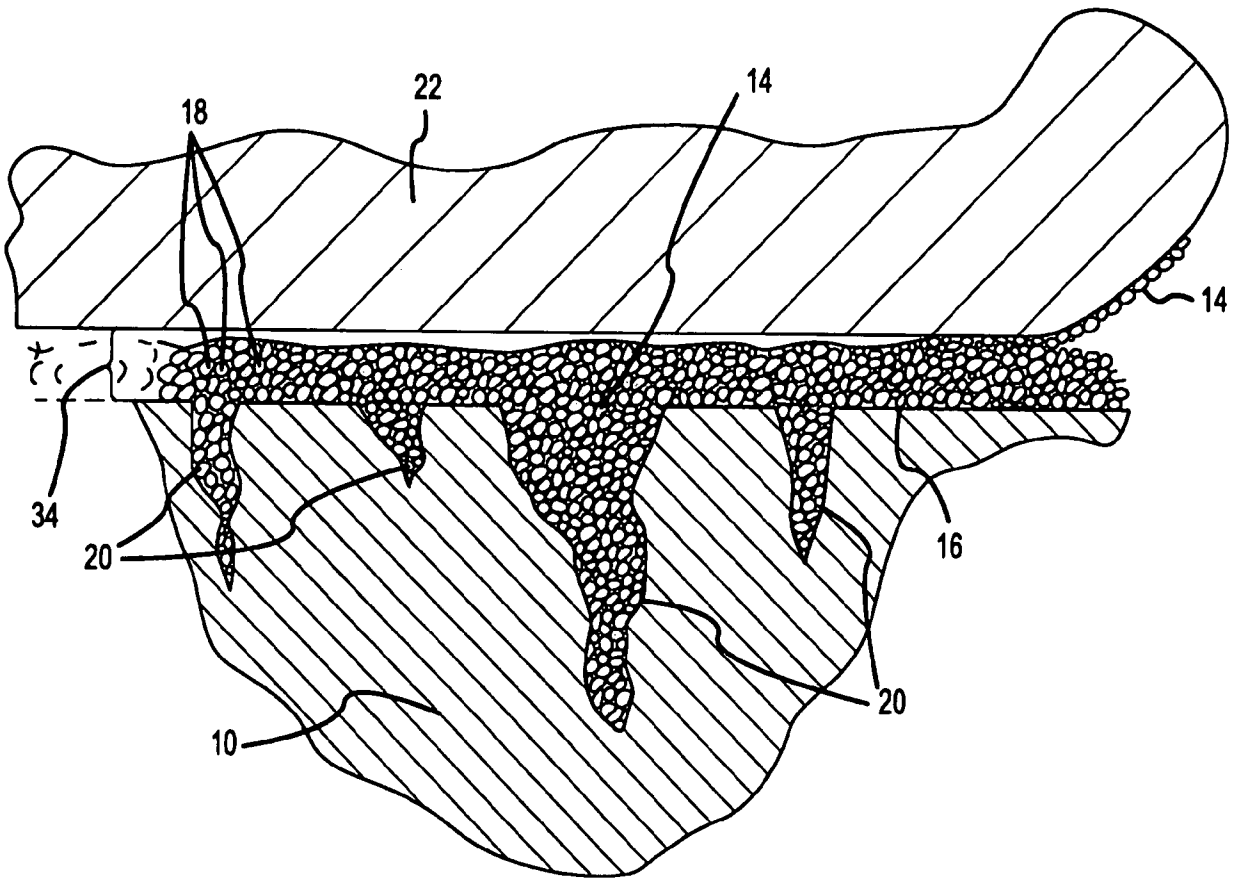
FIG. 6 is a cross-sectional micro-scopic view of boron nitride powder burnished into an internal bore surface filling grain boundaries with sub-micron sized particles and filling the clearance between the bore surface and an ammunition projectile traveling through the gun barrel.

As shown in FIG. 1, in one embodiment, the projectile 22 comprises a shotgun shell 24 having a wad 26 comprising an outer surface 28 coated with boron nitride powder 14. Referring now to FIGS. 4 and 5 by way of example only, in other embodiments, the projectile 22 comprises a bullet 30 or an artillery projectile coated with particulate 14. In yet other embodiments, the projectile 22 comprises a black powder gun shot (not shown) using a boron nitride powder coated patch or sabot 32 corresponding to a black powder muzzle loader (not shown). In yet other embodiments, at least 1 of every about 5 projectiles 22 introduced in conjunction with normal use of the gun barrel 10 is coated with the boron nitride powder 14. Such a cycle is consistent, for example, with the cycle of tracer rounds mixed in with regular rounds in artillery and small arms fire.

In one embodiment, an excess amount of boron nitride powder 14 is introduced into the bore 12 of the gun barrel 10 for burnishing. In other embodiments, the excess substantially fills the normal clearance 34 between the bore surface 16 and any projectile 22 corresponding to the gun barrel 10. One result of this is that a projectile being fired experiences reduced or eliminated chatter while traveling through the gun barrel.

With regard to mechanically introducing and burnishing boron nitride powder 14, the present invention includes embodiments of ammunition projectiles 22 and related equipment and pieces that are coated with enough boron nitride powder 14 to treat the bore 12 of gun barrels 10.

Figure 3:
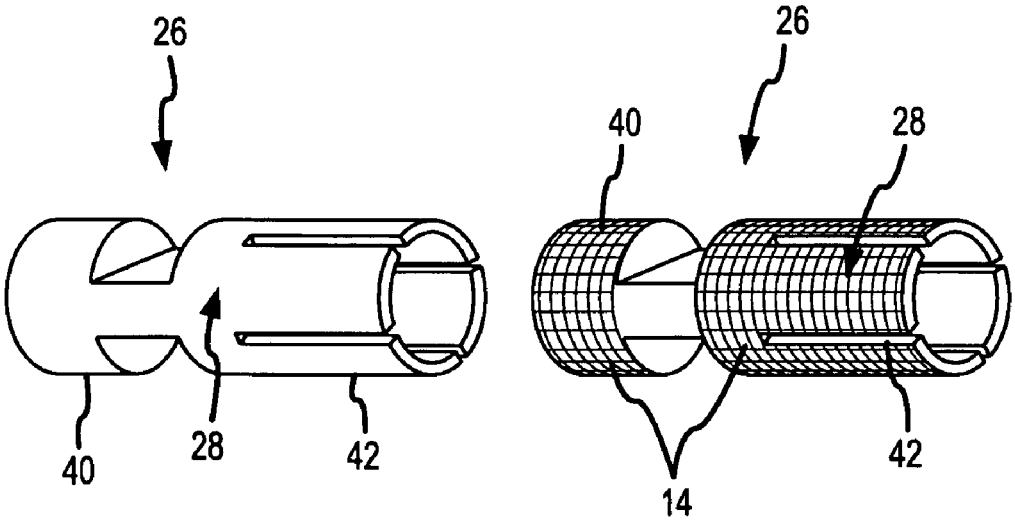
FIG. 3 is a perspective view of a coated wad next to an uncoated wad.
Figure 2:
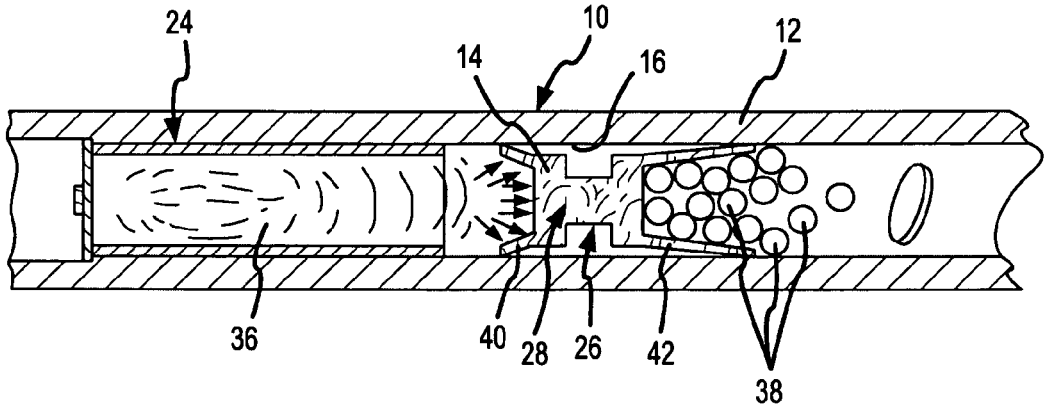
FIG. 2 is a side view of a shotgun shell with a boron nitride powder coated wad in one stage of firing through a gun barrel.

As shown in FIGS. 1 through 3, a boron nitride powder coated wad 26 may be provided with an ammunition cartridge such as a shotgun shell 24. Generally, a wad 26 separates ignition material (gun powder) 36 from a bullet, shot, or artillery shell or mortar 38. A wad 26 comprises a powder seal 40 and a shot seal 42 connected to the powder seal forward of the powder seal as the cartridge 24 is loaded into a firearm or artillery launcher. As shown in FIG. 2, the powder seal 40 in a wad 26 is driven forward in the internal bore 12 by the expanding gases of the burning gun powder 36 when a round is fired, and prevents gas pressure from by-passing the bullet, shot, or artillery shell or mortar 38 down the length of the barrel 10. A shot seal 42 is another such gas seal that drives the shot, etc. 38 down the barrel 10. The outer surface 28 of the wad 26 about one or both seals 40, 42 normally contacts the internal bore surface 16 as the wad 26 travels down the barrel 10.

In one embodiment of the present invention, a wad 26 such as in FIG. 3 is provided that has the outer surface 28 about one or both seals 40, 42 coated with boron nitride powder 14. In other embodiments, the wad outer surface 28 is coated sufficiently with boron nitride powder 14 in order to substantially prevent direct contact between the outer surface 28 and the internal bore surface 16 as a result of boron nitride powder 14 being transferred from the outer surface to the steel surface and into grain boundaries 20 of the internal bore 12. In yet other embodiments, the velocity and pressure and temperature conditions present as the ammunition projectile 22 travels along the internal bore 12 causes the boron nitride powder 14 to be burnished into the internal bore 12 and particles 18 of the boron nitride powder 14 to substantially fill the grain boundaries 20 of the steel surface 16 of the bore 12.

As shown in FIGS. 4 and 5, an apparatus in accordance with the present invention may comprise an ammunition projectile 22 comprising a munition 44 such as a bullet, bullet casing, artillery shell, rifle shell, sabot, black powder patch or a black powder wad, such munition 44 being coated with boron nitride powder 14. In one embodiment, similar to the wad 26 disclosed above, the munition 44 is coated sufficiently with boron nitride powder 14 in order to substantially prevent direct contact between the munition 44 as well as the projectile 22 and the internal bore 12 of the gun barrel 10. Any excess boron nitride powder 14 remains on the surface 16 of the bore 12 or is expelled along with the projectile 22 and also reduces or eliminates projectile chatter.

Use of the embodiments of the method and apparatus of the present invention may be more clear after reference to the following examples:

EXAMPLE NO. 1

Figure 7:
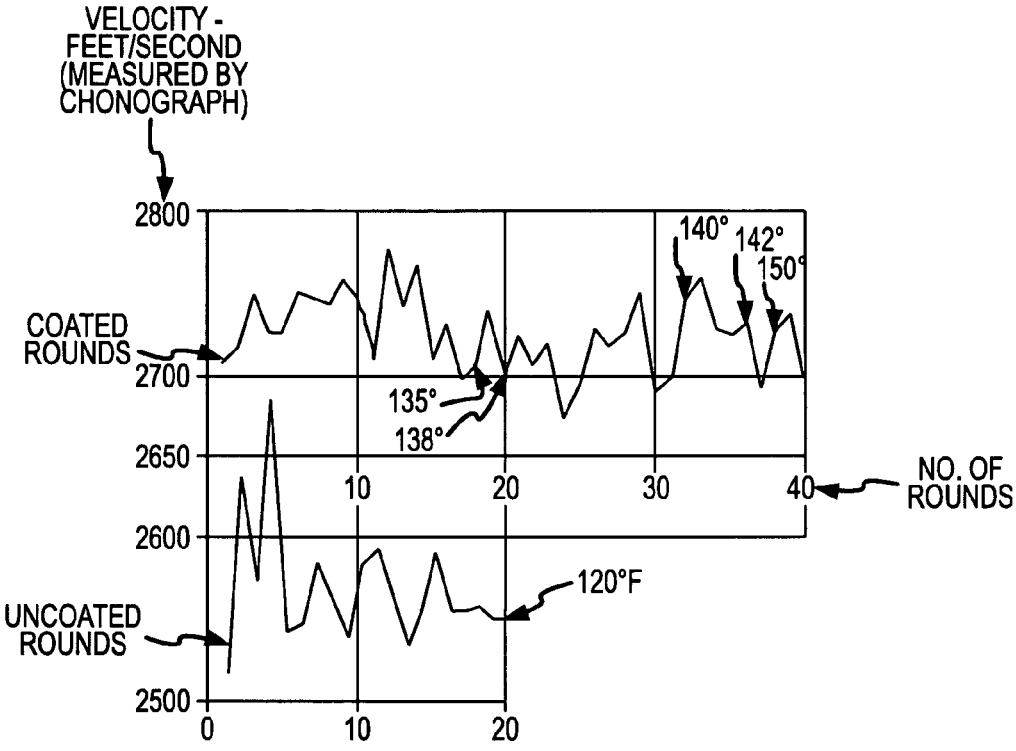
FIG. 7 is a graph of coated and uncoated rounds fired versus muzzle velocity.

A 0.308 caliber firearm was loaded with a series of boron nitride powder-coated rounds as well as a series of uncoated rounds. The velocity of the rounds exiting the barrel of the firearm as well as the temperature of the firearm barrel were measured in feet per second by a chronograph and in degrees Fahrenheit, respectively, to determine velocity and temperature effects of metal oxide powder implantation by burnishing the internal bore of the barrel with a suitable dry lubricating ceramic particulate. See FIG. 7 for specific results.

Summary of results 20 uncoated rounds had an average muzzle velocity of 2368 feet per second and a maximum barrel temperature of 120° Fahrenheit. A first set of 20 boron nitride powder-coated rounds had an average muzzle velocity of 2732 feet per second and a maximum barrel temperature of 138° Fahrenheit. A second set of 20 boron nitride powder-coated rounds had an average muzzle velocity of 2719 feet per second and a maximum barrel temperature of 150° Fahrenheit. The average gain in muzzle velocity by coating rounds with boron nitride powder was 157 feet per second. The average gain in barrel temperature was 18° Fahrenheit.

Note

The temperature increase was likely caused as a result of the particulate being burnished into the internal bore, representing the thermal work being bestowed upon the barrel. The likelihood is that barrel temperature will be reduced as the internal bore is further treated with particulate.

EXAMPLE NO. 2

A Winchester Rifle Model 70 Ultra-Match having a 25 inch barrel, 1–12 inch twist, 4 groove was used to fire 4 different sets of coated and uncoated rounds. All rounds comprised gun powder type IMR 4895 in an amount of 41½ grains, a bullet comprising 168 grain Sierra MK, a primer comprising Remington 9½, a case comprising L.C.N.N., and loaded round length comprising 2.800. Time between fired rounds was approximately 25 seconds on average, resulting in the barrel becoming too hot to touch.

Figure 8:
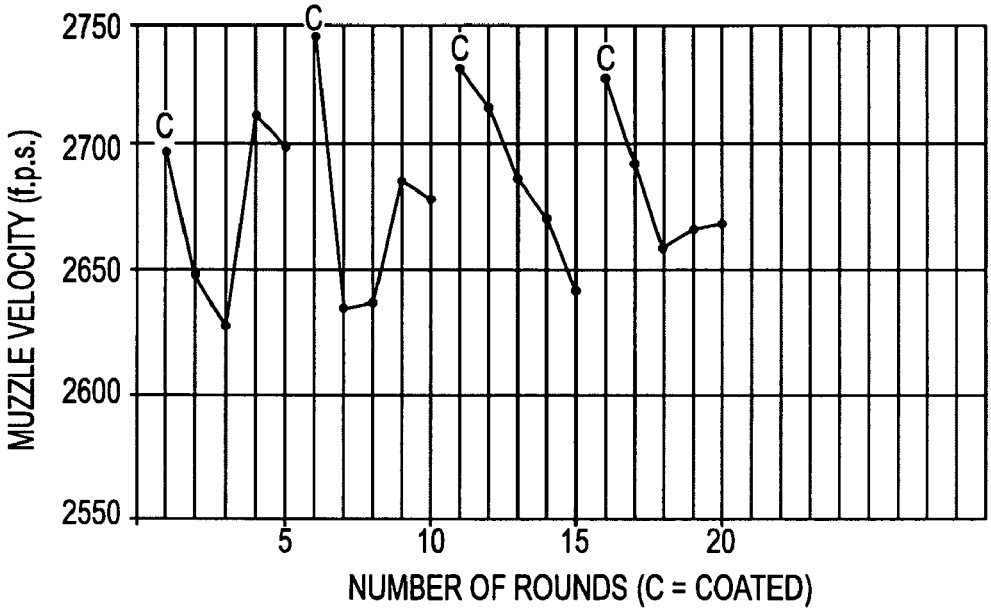
FIG. 8 is a graph showing the results of 20 rounds fired in 4 sets of 1 boron nitride powder coated round followed by 4 uncoated rounds.

FIG. 8 shows results of 20 rounds fired in 4 sets of 1 boron nitride powder-coated rounds followed by 4 uncoated rounds. The average muzzle velocity was 2678 feet per second, with an extreme spread of muzzle velocity among the 20 rounds of 114 feet per second, and a statistical deviation of 34.8.

Figure 9:
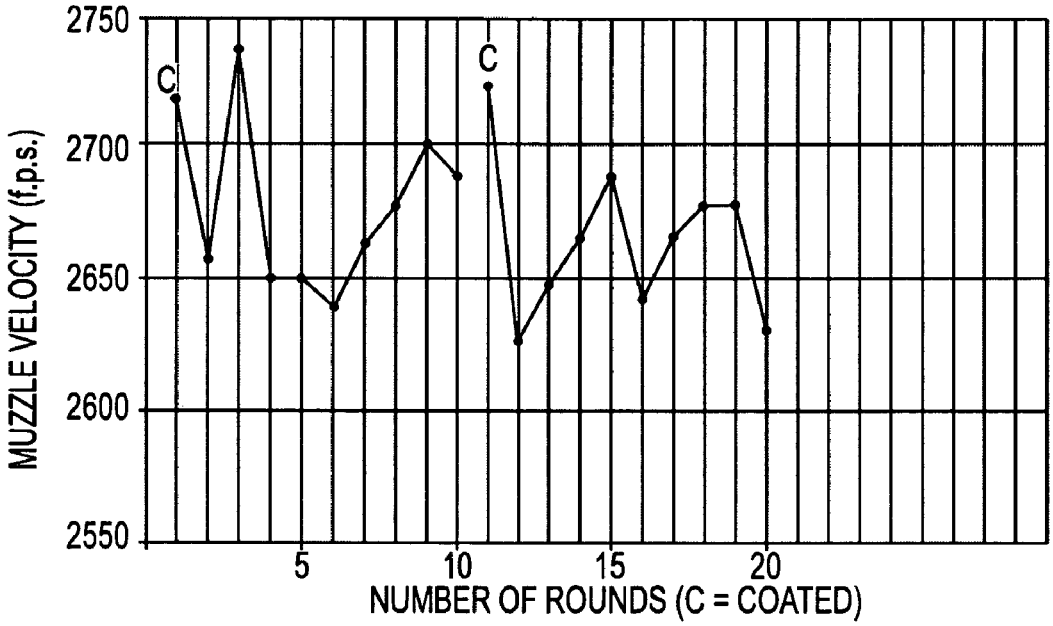
FIG. 9 is a graph showing the results of a second group of 20 rounds fired in two sets of 1 boron nitride powder-coated round followed by 9 uncoated rounds.

FIG. 9 illustrates the results of a second group of 20 rounds fired in 2 sets of 1 boron nitride powder-coated rounds followed by 9 uncoated rounds. The average muzzle velocity was 2669 feet per second, with an extreme spread among the 20 rounds of 114.8 feet per second, and a statistical deviation of 30.4.

Figure 10:
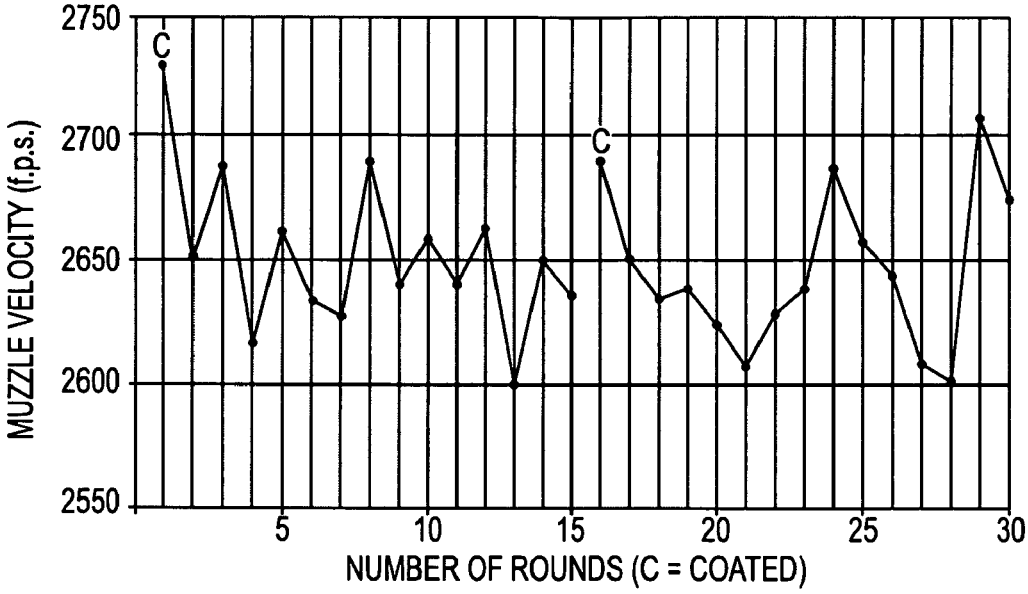
FIG. 10 is a graph showing the results of a third group of 30 rounds fired in two sets of 1 boron nitride powder-coated round followed by 14 uncoated rounds.

FIG. 10 shows the results of a third grouping of 30 rounds fired in 2 sets of 1 boron nitride powder-coated rounds followed by 14 uncoated rounds. For the first set, the average muzzle velocity was 2650 feet per second with an extreme spread among the 15 rounds of 127.5 feet per second and a statistical deviation of 31.8. For the second set, the average muzzle velocity was 2645 feet per second with an extreme spread among the 15 rounds of 107.5 feet per second and a statistical deviation of 32.2.

Figure 11:
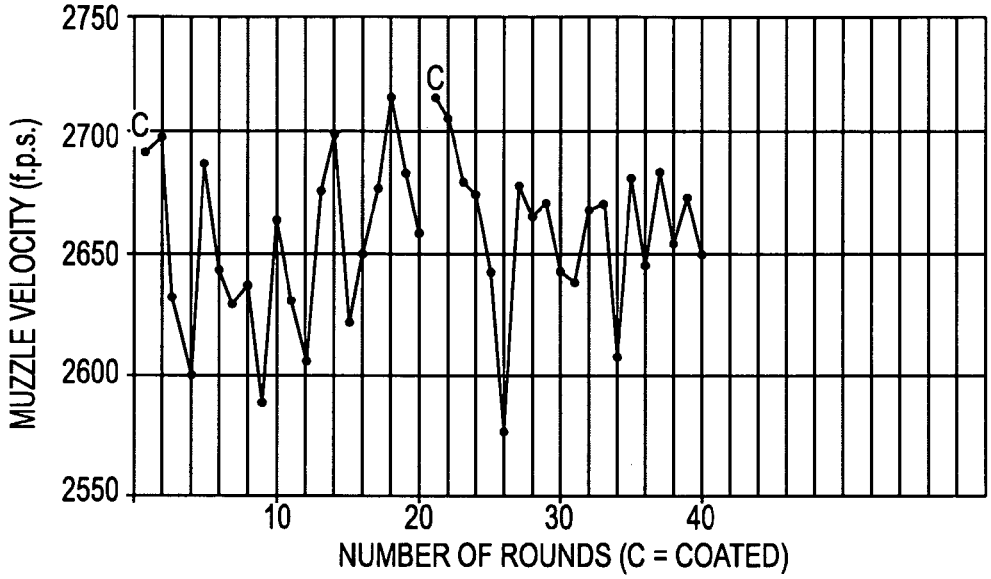
FIG. 11 is a graph showing the results of a fourth group of 40 rounds fired in two sets of 1 boron nitride powder-coated round followed by 19 uncoated rounds.

FIG. 11 shows the results of a fourth group of 40 rounds fired in 2 sets of 1 boron nitride powder-coated rounds followed by 19 uncoated rounds. The first set of rounds had an average muzzle velocity of 2654 feet per second with an extreme spread among the 20 rounds of 126.4 feet per second and a statistical deviation of 36.3. The second set had an average muzzle velocity of 2660 feet per second with an extreme spread among the 20 rounds of 140.6 feet per second and a statistical deviation of 31.9. In all, the 10 boron nitride powder-coated rounds that were fired had an average muzzle velocity of 2714 feet per second.

Table 1 shows the actual muzzle velocity for each coated round from FIGS. 8–11.

TABLE 6

| Round # | Muzzle Vel. (f.p.s.) |
|---|---|
| 1 | 2693 |
| 2 | 2742 |
| 3 | 2730 |
| 4 | 2724 |
| 5 | 2716 |
| 6 | 2720 |
| 7 | 2726 |
| 8 | 2689 |
| 9 | 2687 |
| 10 | 2715 |

There is definite improvement in gun barrel life by wear and distortion reduction as a result of the present invention. The primary wear surface in accordance with the present invention is the boron nitride powder, which is continually replaced. The powder is a common industrial material and thus is relatively inexpensive. No gun barrel cleaning is generally required in accordance with the present invention, nor is there need for gun barrel lubrication because the gun barrel will not collect dirt or sand in lubricants commonly used. There is no rust or corrosion as a result of the grain boundaries being filled in by the sub-micron particles of boron nitride powder. There is also increased muzzle velocity and increased accuracy as a result of practicing the present invention. One performance improvement is the deletion or removal of chrome plating that is typical in government issue gun barrels. The sub-micron particles of boron nitride powder have no grain boundaries to hide in on a chrome surface. As a result, some of the advantages of the present invention will be lost until the chrome plating strips off (which normally happens anyway) or is removed, or until a stainless steel surface is resurfaced, such as by chemical or mechanical etching. The use of boron nitride powder coated bullets on one out of every five bullets fired will result in the advantages of the present invention, and such a one-in-five cycle is typical of tracer rounds.

While various specific embodiments of the invention have been shown and described for purposes of illustration, the protection afforded by any patent which may issue upon this application is not strictly limited to the disclosed embodiments, but rather extends to all structures, arrangements and methods which fall fairly within the scope of the claims which are appended hereto:

What is claimed is:

1. A method for at least partially burnishing the bore of a gun barrel with a dry lubricant, said method including the steps of:

a. providing a gun barrel having a bore, said bore having at least one surface, said surface having grain boundaries;

b. providing a first quantity of hexagonal boron nitride powder; and c. burnishing at least a portion of said first quantity of hexagonal boron nitride powder into at least portions of said grain boundaries during a first interval of time.

2. The method as set forth in claim 1, wherein said burnishing is repeated at least two times, each of said repeated burnishings including the step of providing an additional quantity of hexagonal boron nitride powder and the step of burnishing at least a portion of said additional quantity of hexagonal boron nitride powder into at least portions of said grain boundaries during an interval of time subsequent to said first interval of time.

3. The method as set forth in claim 2, further including the step of providing a plurality of projectiles, each of said projectiles having an external surface capable of being driven through said bore, wherein each of said steps of providing a quantity of hexagonal boron nitride powder takes the form of coating at least a portion of said surface of each of said projectiles with said hexagonal boron nitride powder, and wherein each of said burnishing steps takes the form of successively driving each of said projectiles through said bore, each of said steps of driving said projectile through said bore driving at least some of said hexagonal boron nitride powder into at least portions of said grain boundaries.

4. The method as set forth in claim 3, wherein said step of driving at least some of said hexagonal boron nitride powder is accomplished by the velocity, heat and pressure of driving each of said projectiles through said bore.

5. The method as set forth in claim 3, wherein said step of providing a plurality of projectiles takes the form of providing a plurality of bullets, and wherein each of said steps of coating takes the form of at least partially coating each of said bullets.

6. The method as set forth in claim 5, wherein said step of providing a plurality of bullets takes the form of providing a like plurality of rounds of ammunition, each of said rounds of ammunition including a case, powder, a primer and one of said at least a partially coated bullets, and wherein each of said step of driving said projectile through said bore includes the step of firing one of said rounds of ammunition to drive said bullet associated with said round of ammunition through said bore.

7. The method as set forth in claim 3, wherein said step of providing a plurality of projectiles takes the form of providing a plurality of sabots, and wherein the step of coating takes the form of at least partially coatint an external surface on each of said sabots.

* * * * *